United States Patent [19]

Meidan

[11] Patent Number: 4,752,243

[45] Date of Patent: Jun. 21, 1988

[54] FUSE PLUG

[75] Inventor: Daniel Meidan, North York, Canada

[73] Assignee: Noma Inc., Scarborough, Canada

[21] Appl. No.: 56,823

[22] Filed: Jun. 2, 1987

[51] Int. Cl.[4] ..... H01R 13/68

[52] U.S. Cl. ..... 439/622; 337/198

[58] Field of Search ..... 337/197, 198, 201, 211, 337/213, 217-220; 439/621, 622

[56] References Cited

U.S. PATENT DOCUMENTS

| | | | |
|---|---|---|---|
| 1,902,568 | 3/1933 | Maxam | 337/188 |
| 2,644,056 | 6/1953 | Curtis | 337/198 |
| 2,988,617 | 6/1961 | Graziosi | 439/621 |
| 3,218,413 | 11/1965 | Koch | 337/197 |
| 3,716,820 | 2/1973 | Deakin | 439/596 |
| 4,178,061 | 12/1979 | Ahroni | 439/622 |
| 4,274,698 | 6/1981 | Ahroni | 439/622 |
| 4,418,978 | 12/1983 | Shamir | 439/409 |
| 4,679,877 | 7/1987 | Ahroni | 337/198 |

FOREIGN PATENT DOCUMENTS

| | | | |
|---|---|---|---|
| 609337 | 9/1948 | United Kingdom | 337/213 |

*Primary Examiner*—Gil Weidenfeld
*Assistant Examiner*—Gary F. Paumen
*Attorney, Agent, or Firm*—Kenneth M. Garrett

[57] ABSTRACT

A fuse connector which may be in the form of a one-piece plug connector molded onto a wire cord uses a standard cartridge fuse that is contained within the body of the connector. The body is provided with windows through which the fuse is visible and through which the fuse may be withdrawn or inserted without opening the body and without the use of special tools.

17 Claims, 4 Drawing Sheets

FUSE PLUG

FIELD OF INVENTION

This invention relates to a fused electrical connector. While it is particularly described in relation to a plug for insertion into a convenience receptacle, especially one wherein the plug is adapted for molding onto a wire cord, it is not necessarily restricted thereto.

BACKGROUND OF INVENTION

Fused connectors of many different types are known. In all instances the fuse is enclosed within the connector housing, wherein it is not normally visible until such time as the housing is opened.

Generally speaking, housings are operable only by the use of a tool such as a screw driver, although in U.S. Pat. No. 4,418,978 (Shamir) a hinged and auto latching housing is described which may be opened by unlatching to gain access to the fuse.

In U.S. Pat. No. 3,218,483 (Koch) a bore is provided in the plug housing; the bore has a plunger captured therein which serves to expel the fuse axially through an opening in the housing wall in order that the fuse be inspected and or changed.

Recently at least one fused plug has been marketed having an inspection window in one wall thereof through which the body of the fuse is visible. However, such window must of necessity be small to preclude an object inserted therethrough coming into contact with a conducting portion of the connector, and it is not readily ascertainable whether or not the fusible element is intact.

It is of course possible to construct the housings in whole or in part from a clear grade of plastic material for example, or to adopt other expedients that would reveal either directly or indirectly the state of the fuse, but these are not economically feasible in low cost connectors such as are envisaged herein.

It is an object of this invention to provide a fuse connector in which the fusible element may be more readily seen.

It is another object of the invention to provide a fuse connector wherein the fuse may be replaced without requiring the housing to be opened, and without the use of any particular tool.

It is yet another object of the invention to provide a fuse connector wherein the fuse may be inserted and withdrawn from the housing without requiring the use of any particular tool, or the use of any movable parts incorporated into the housing.

It is still another object of the invention to provide a fuse connector which is suitable for molding onto a wire conductor.

It is a further object of the invention to provide a fuse connector wherein the housing is formed as a single molding.

It is yet another aspect of the invention to provide a fused plug connector wherein the fuse may only be removed or inserted when the plug is disconnected from a receptacle.

SUMMARY OF INVENTION

In accordance with a broad aspect of the invention, a fuse connector comprises insulating wall structure defining a hollow enclosure including a base wall and a top wall spaced apart therefrom. The wall structure further defines a passageway located within the enclosure which extends in an axial direction. The top wall and base wall are each provided with axially elongated openings therethrough which communicate with the passageway, and which reside in and define an axial plane, arbitrarily considered as being vertically oriented, and which permit lines of sight through the enclosure. Consequently an axially extending fuse located in the passageway may be clearly visible particularly when the enclosure is viewed towards a light source.

Resilient electrodes are provided within the housing to contact the end caps of the fuse. Where the electodes drop into locating passages that are pre-formed in a housing, the shape of the electrodes can be relatively complex, and the electrodes themselves can grip a fuse cap inserted therebetween. Where the electrodes are molded into the housing structure, the electrodes will normally be relatively unstructured, with linear planar electrodes being preferred, at least in the portions thereof that are not to be embedded in the molding material.

In accordance with the preferred embodiment, the electrodes locate adjacent each axial end of the fuse but on transversely opposed sides thereof, so as to contact the fuse caps tangentially somewhat above the horizontal diametric plane. The passage within which the fuse body locates is structured to restrict the skew rotation of the fuse, and the movement of the fuse in the axial plane towards the base of the housing, under the influence of the pressure exerted by the resilient electrodes.

The opening in the base wall of the enclosure is sufficiently large to permit a fuse to be introduced therethrough into the housing when the fuse is inclined to the horizontal in the axial plane. When the fuse is introduced in this manner, the upper end of the fuse engages a transverse wall provided within the housing. The application of a force on the lower end of the fuse then causes the fuse to rotate about the transverse wall, and wedge apart the passage walls, and the fuse becomes firmly gripped by the passage walls.

When it is desired to replace the fuse, a force is exerted on the body of the fuse by means of a house key or similar convenient object which is inserted into the enclosure through the opening in the top wall. In the preferred embodiment, standard electrical prongs project from below the base wall for connecting to a receptacle. Accordingly, the fuse cannot pass through the opening in the base wall until such time as the plug is withdrawn from the receptacle.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
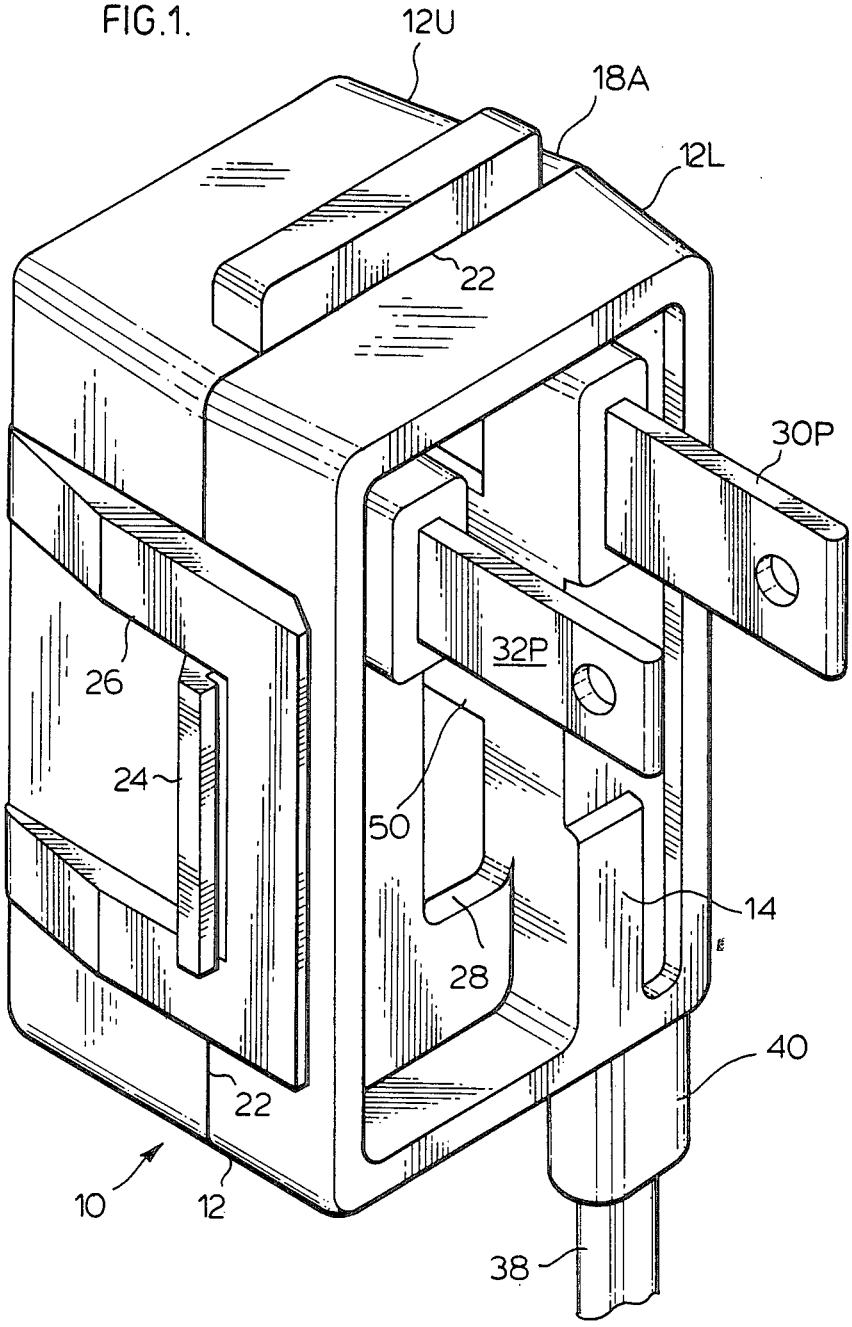
FIG. 1—shows a fuse plug connector constructed in accordance with the invention in perspective view from the base thereof.

Referring to the drawings in detail, a plug connector constructed in accordance with the invention is identified therein by the numeral 10. Connector 10 comprises a hollow, insulating housing 12 which is generally in the form of a rectangular prism formed by base wall 14, a top wall 16 opposed to the base wall, opposed end walls 18A,18B and opposed flank walls 20A,20B. Where it is not required to differentiate between the end walls 18A,18B these may be simply referred to by the numeral 18; similarly flank walls 20A,20B may be simply referred to by the numeral 20.

Housing 12 comprises an upper portion 12U, and a lower portion 12L, which meet on a shut surface 22; the two portions are conveniently molded as a single unit interconnected along flank wall 20A at about mid height thereof, at edge 22, by a live hinge 23. The opposed flank wall 20B is provided with a snap closure formed by a tab 24 extending outwardly from the lower portion thereof, and a hook 26 extending downwardly from the upper portion of flank wall 20B. Hook 26 is engaged with tab 24 in a machine press operation as it is not intended that housing 12 be opened in use. The two housing halves 12U, 12L could be separately molded and welded or otherwise conjoined as convenient.

Base wall 14 is provided with a rectangular opening 28 therethrough, the major axis thereof arbitrarily defining the axis of the connector. On each lateral side of opening 28, and adjacent to end wall 18A, generally opposed strip electrodes 30,32 are mounted by molding. Lower portions 30P,32P of the electrodes project downwardly from base wall 14, and are configured as prongs for entry into a standard receptacle outlet; the prongs are arbitrarily considered to be oriented with their major dimension i.e. their length, the vertical direction, and their minor dimension, i.e. their width, in the axial direction. Upper portions 30U,32U of the electrodes project above base wall 14 into the hollow space enclosed by housing 12. As molded, electrode upper portions 30U,32U will be parallel and vertically oriented, although not necessary coplanar with the lower portions of the electrodes, to permit them to be received in mold cavities and withdrawn therefrom in the molding process. As illustrated, electrode 30 is wider than electrode 32, serving the purpose of the neutral blade in a polarized plug 10. It may be remarked that the upper electrode portion 30U serves only the purpose of locating electrode 30 during the molding process, and it could be subsequently clipped off if desired. If not intended to be clipped, electrode portion 30U may be conveniently coated with insulation during the molding process.

Figure 2:
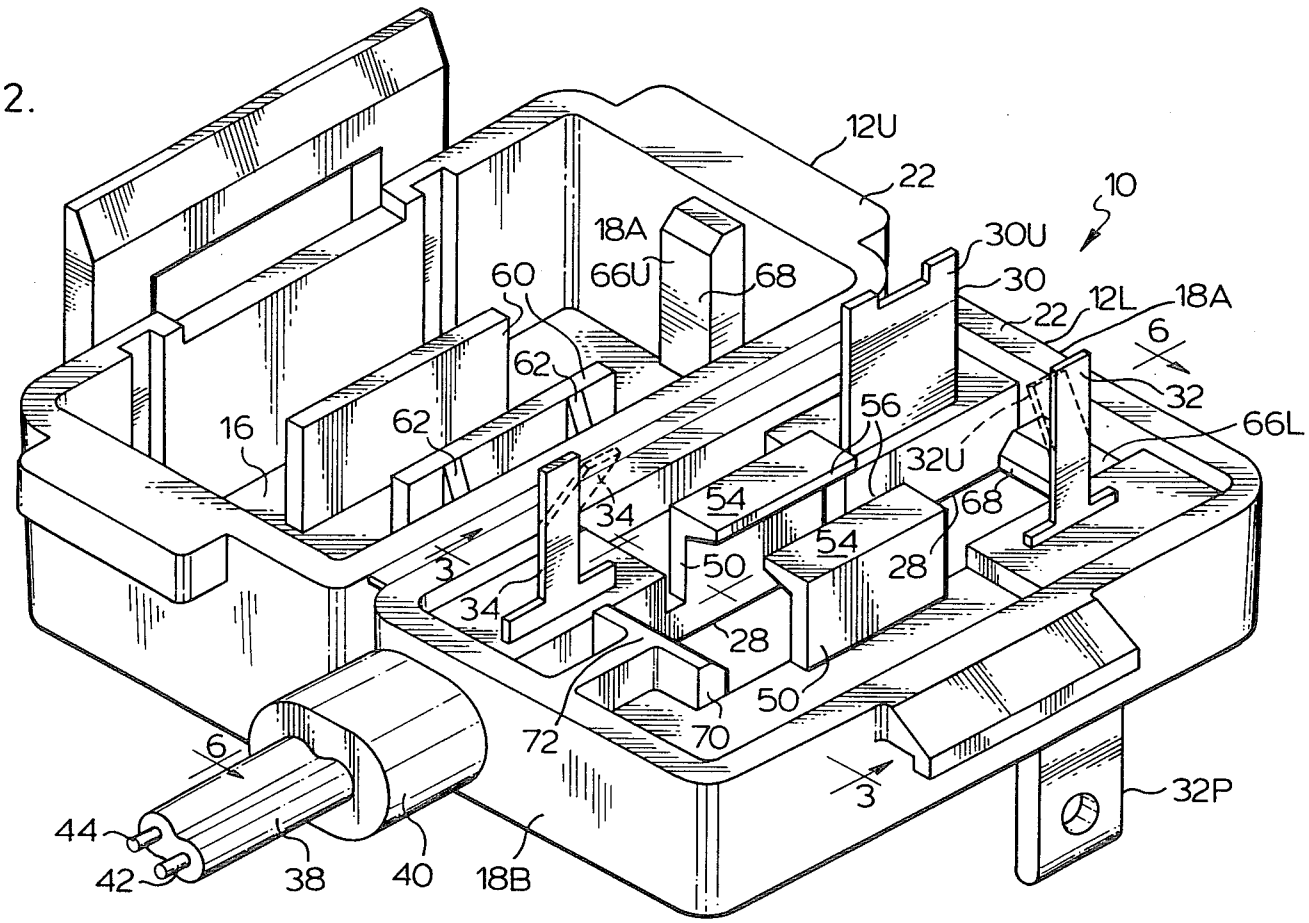
FIG. 2—shows the housing of the connector of FIG. 1 as molded, with portions shown in dashed outline indicating a subsequent manufacturing operation to upset the electrodes.

At the other axial end of base wall 14, which is to say adjacent end wall 18B, a third vertically oriented strip electrode 34 is provided on the transverse side of opening 28 opposed to electrode 32. Electrode 34 is similarly molded into position, and together with electrode 32, is aligned with its width in the axial direction. The upper portion of electrodes 32 and 34 serve as fuse contacts and are each deformed subsequent to molding towards opening 28, although in opposite directions, as suggested in dashed outline in FIG. 2.

Electrode 34 terminates within base wall 14, having no portion thereof corresponding to either portion 30P and 32P of the other electrodes.

Figure 3:
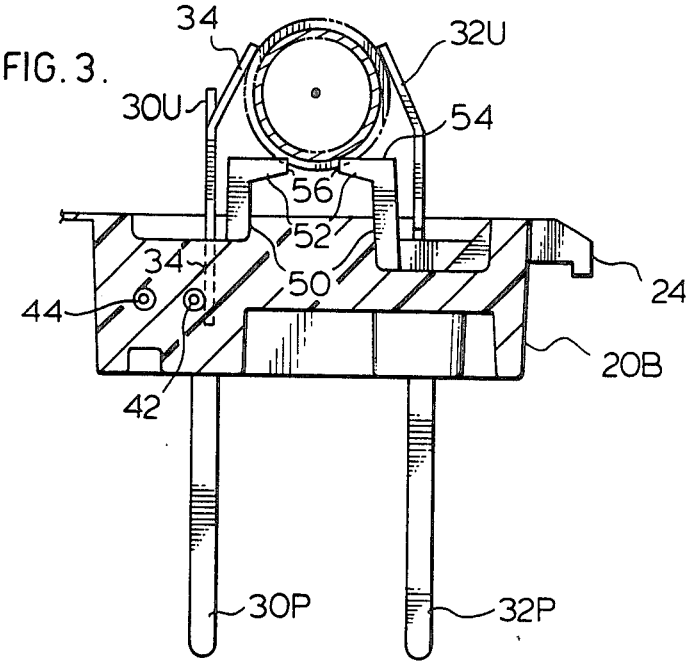
FIG. 3—is a sectinal view along line 3—3 of FIG. 2, with a fuse in position in the housing.
Figure 4:
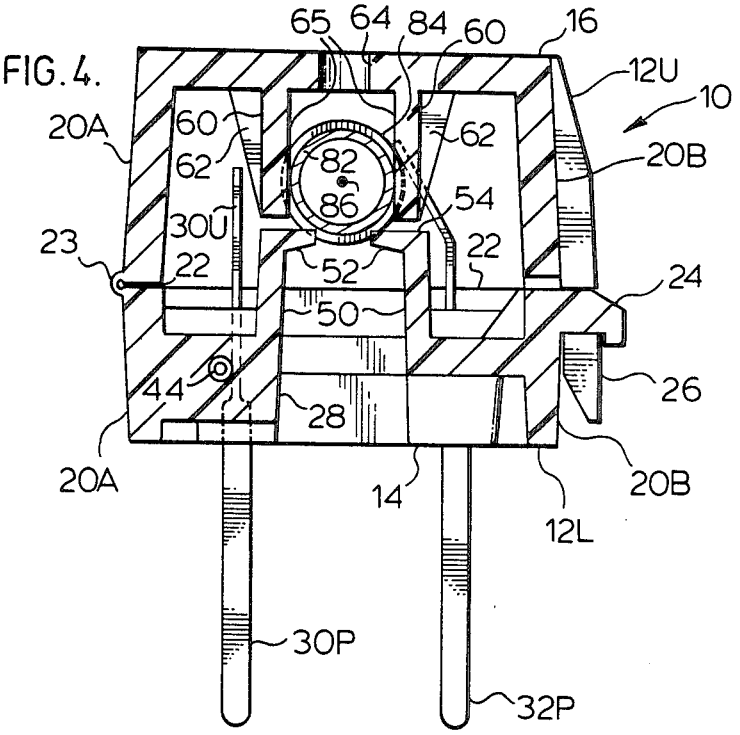
FIG. 4—is a sectional view along line 4—4 of FIG. 2, with a fuse and the upper portion of the housing in place.
Figure 5:
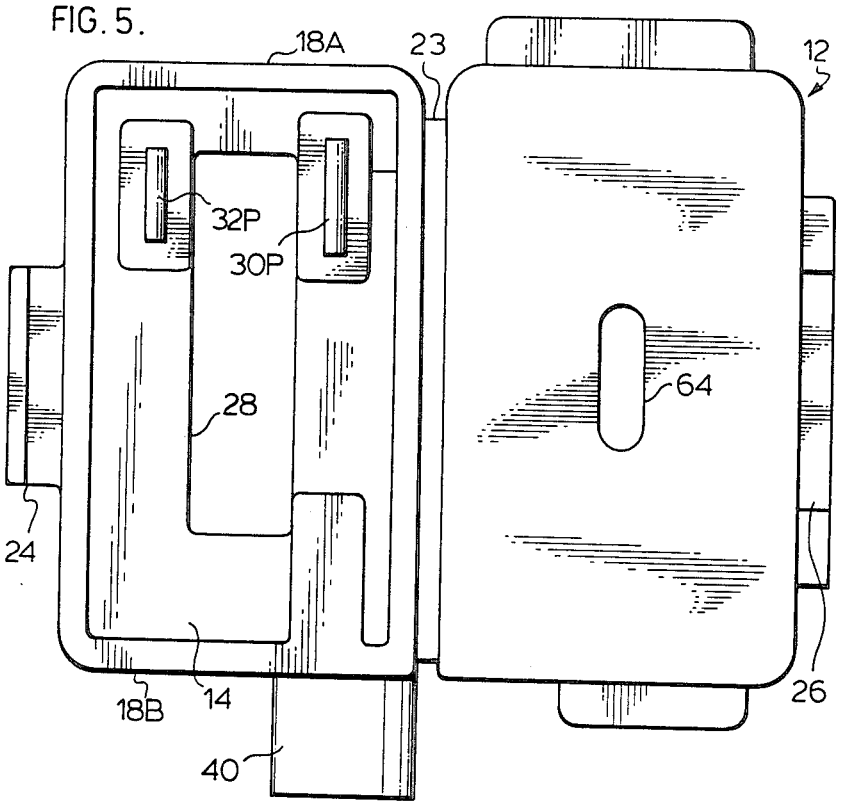
FIG. 5—is a base plan view of the connector of FIG. 1.

A twin wire cord 38 enters housing 12 through a strain relief extension 40 which extends horizontally outwardly from end wall 18B integrally therewith. The conductors 42,44 of cord 38 where they enter housing 12, are embedded and molded into base wall 14, and welded or otherwise connected as convenient to electrodes 30,34 in the embedded portions thereof, as suggested in dashed outline in FIGS. 3 and 4.

Upstanding from base wall 14 and integral therewith there is provided on each lateral side of opening 28 intermediate the axial ends thereof a pair of similar opposed axially aligned walls 50, the upper end of each of which is inwardly turned at 52, to form a generally horizontal platform 54, the opposed edges 56 of which are spaced apart as will be later referred to in greater detail.

Downwardly depending from top wall 16 and integral therewith there is provided a pair of similar opposed axially aligned walls 60, which when the upper and lower portions 12U, 12L of the housing are closed together, approach the platform surface 54. Walls 60 are strengthend by buttresses 62 formed on the outwardly facing surface thereof.

An axially elongated window opening 64 is provided in top wall 16 between opposed walls 60. Both the length and the width of window opening 64 are less the the corresponding dimensions of opening 28 in base wall 14. It will be appreciated that openings 64 and 28 permit a line of sight through housing 12 between walls 50 and 60. It will further be appreciated that effectively walls 50 and 60 combine to form an axially extending passageway 65 extending between electrodes 32,34, and that platform 54 provides a restriction therein.

Opening 28 is formed in base wall 14 with one axial end of the opening closer to one end wall of housing 12 than the other, this being preferably the end wall 18A, at which end the plug prongs 30P,32P locate as illustrated. End wall 18A is built up by a small pier 66 comprising upper and lower portions 66U, 66L the inwardly facing surface 68 of which is generally vertically aligned with the axial end of opening 28.

At the opposed axial end of opening 28 there is provided a transversely aligned wall 70 having an upper surface 72 locating in a plane somewhat lower than the plane of platform 54, and axially spaced apart therefrom, wall 70 also being axially spaced apart from the interior surface of end wall 18B.

Figure 6:
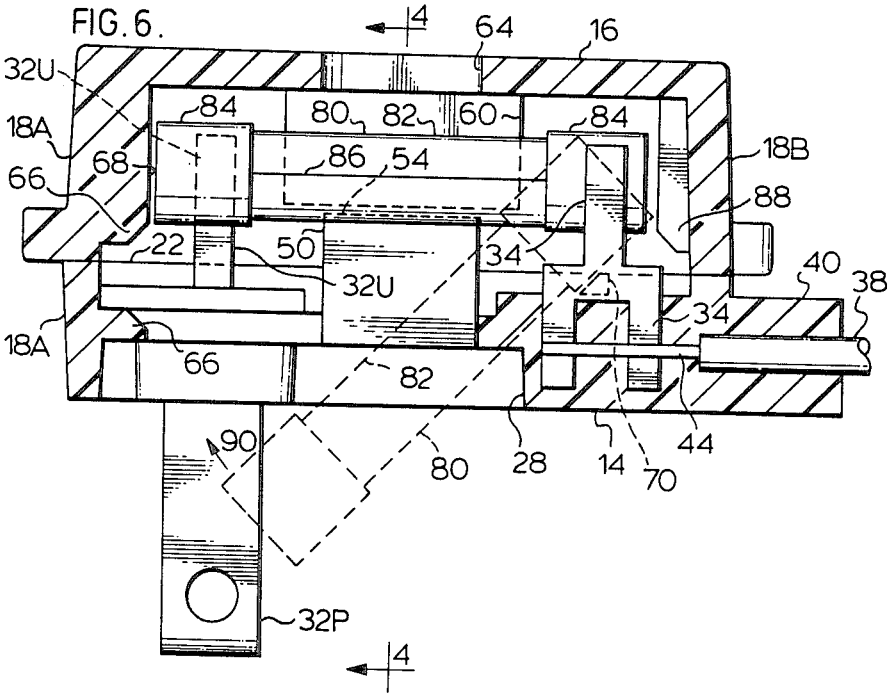
FIG. 6—is a sectional view along line 6—6 of FIG. 2, illustrating the manner of introduction of a fuse into the connector housing.

With particular reference to FIG. 6, a fuse 80 for use in combination with plug connector 10 comprises a body portion 82 conveniently of glass, conducting end caps 84 and a fusible element 86 interconnecting the end caps. As indicated in dashed outline, fuse 80 is inserted into housing 12 through base wall opening 28 by inclining the fuse in the vertical axial plane, and inserting one end through the opening into abutment with the interior surface of end wall 18B, or more particularly a small pier 88 similar to pier 66 on the opposed end wall, with a fuse cap 84 reposing on transverse wall 70. In this initial position of entry of fuse 80 into housing 12, walls 60 and platform 54 do not interfere with the fuse. Pressure is then applied to other (exposed) end of fuse 80 in the direction of the arrow 90, causing the fuse to rotate in the vertical axial plane about transverse wall 70 which provides a fulcrum surface, hence wall 70 may also be referred to as a fulcrum wall. As fuse 80 is rotated in this manner, the body 82 will contact the opposed edges 56 of platform 54, which may be suitably spaced apart by a distance of about one half the diameter of the fuse body. The fuse body 82 wedges the opposed portions of platform 54 apart, it being understood that housing 12 will normally be formed of a resilient insulating material, for example PVC or other suitable thermoplastic material. As the other end of fuse 80 is rotated into housing 12, pressure may be transmitted to the fuse by using a pencil or key or other convenient instrument, with no particular tool being required, until the fuse passes to the upper side of platform 54, in which position its body 82 is firmly gripped between walls 60. Electrodes 32U,34 locate so as to contact the respective end caps 84 of fuse 80 somewhat above the medial horizontal plane of the fuse, and to be resiliently biased upwardly and outwardly by the fuse as it is urged by manual pressure into its position within housing 12. Electrodes 32U,34 will then exert a reactive force on fuse 80 tending to rotate it in its horizontal medial plane, and also to urge it downwardly towards opening 28, and these reactive forces are expended on walls 60 and 54 respectively.

When fuse 80 is positioned in housing 12, the fusible element 86 will be clearly visible by viewing through window opening 64 provided in top wall 16, particularly if plug connector 10 is held up to a light source facing base wall opening 28.

In the event that it is required to change fuse 80, pressure is exerted thereon by a house key or the like applied through window opening 64, so as to cause the fuse to rotate in a contrary manner to that in which it was inserted into the housing.

It will be apparent from the foregoing description that many changes may be made to the illustrated embodiment both for structural and aesthetic reasons, while achieving at least some of the aims, objects and advantages of the invention. It is intended that all such variations that fall within the spirit of the claims appended hereto be encompassed by the invention.

I claim:

1. A fuse connector comprising:

insulating wall structure defining a hollow enclosure including a base wall and a top wall spaced therefrom, and further defining an axially extending passageway within said enclosure;

said base wall and said top wall each having an axially extending slot therethrough in communication with said passageway to provide a line of sight through said enclosure in an axial plane;

a cartridge fuse mounted within said passageway in axial alignment therewith, said cartridge fuse having a central glass body portion and conducting end caps thereon;

the wall structure defining said passageway being adapted to grip said fuse body portion, and a resilient electrode mounted from said wall structure adjacent each axial end of said passageway located to exert a contact pressure on the respective end caps of said fuse tending to urge said fuse towards said base wall, which force is spent on the walls defining said passageway.

2. A fuse connector as defined in claim 1, wherein said electrodes are located such that said contact pressure exerts a force on said fuse tending to rotate said fuse out of said axial plane, which force is spent on the walls defining said passageway.

3. A fuse connector as defined in claim 1, wherein said wall structure defining said passageway comprises upper portions connected to said top wall, and lower portions connected to said base wall, said upper portions not being directly interconnected to said lower portions.

4. A fuse connector as defined in claim 3, wherein said passageway is constricted in width at about mid-height thereof, the upper surface of the constriction serving as a locating platform for the body of said fuse.

5. A fuse connector as defined in claim 4, wherein said wall structure further includes a transverse fulcrum wall axially outwardly spaced from an axial end of the wall structure defining the passageway, said fulcrum serving to engage one axial end of said fuse when it is inserted through said opening in said base wall at an angle thereto as measured in said axial plane, in which position intermediate body portions of said fuse engage said passageway in constricted portions thereof, so that such intermediate body portions act to spring the wall structure defining said passageway apart as an upward force is applied to the other axial end of said fuse, thereby permitting the entry of said fuse into the enclosure to a position within said passageway above said platform.

6. A fuse connector as defined in claim 1, including electrically conducting prongs projecting downwardly from said base wall, at least one said prong being electrically connected with one said electrode.

7. A fuse connector as defined in claim 1, including a pair of transversely spaced apart electrically conducting prongs projecting downwardly from said base wall, one said prong being unitarily formed with one said electrode, a wire cord having one wire conductor connected to the other of said pair of prongs and another wire conductor connected to the other of said resilient electrodes.

8. A fused plug wherein the fuse may be inserted or withdrawn without necessitating the opening of the plug comprising:

an insulating housing defining a enclosed space therein;

a pair of spaced prongs projecting transversely outwardly from one wall of said housing;

a first axially elongated opening in said one wall connecting to said enclosed space;

a second axially aligned opening in a wall of said housing opposed to said one wall, said second opening connecting to said enclosed space;

insulating wall means defining an axially aligned passageway extending generally between said first and second openings, there being a line of sight through said first and second openings and said passageway;

first resiliently movable electrode means unitarily formed with one said prong projecting within said enclosed space, second resiliently movable electrode means projecting within said enclosed space;

said first and second electrode means locating at axially opposed ends of said insulating wall means, and a cartridge fuse including an insulating body portion and conducting end caps, said electrode means acting to exert a force on said fuse tending to move said fuse towards said first opening, said wall means defining said passageway being adapted to abut the body of said fuse to resist said force, said insulating wall means serving to grip said body portion of said cartridge fuse and retain said end caps thereof in electrical contact with said electrode means.

9. A plug connector as defined in claim 8, wherein said electrodes in the portions thereof contacting said end caps consist essentially of strips having their width aligned in the axial direction.

10. A plug connector as defined in claim 8, wherein said electrode means are located on opposed sides of said passageway.

11. A plug connector is defined in claim 8, wherein said insulating wall means defining said passageway is resiliently deformable.

12. A plug connector as defined in claim 11, wherein said insulating wall means defining said passageway comprises first portions mounted from said housing adjacent said first opening and second portions mounted from said housing adjacent said second opening, said first portions having distal edges terminating adjacent distal edges of the second portions.

13. A plug connector as defined in claim 12, wherein the distal edge of the first portion is turned so as to form a restriction in said passageway, thereby providing a seat for the body of said fuse when in contact with said electrodes.

14. A plug connector as defined in claim 13, including a transversely aligned wall located within said housing adjacent one axial end of said first opening, said transverse wall serving to provide a fulcrum for one axial end of said fuse when initially inserted into said housing through said first opening, whereby the body of said fuse acts to wedge apart the resilient walls of said passageway as said fuse is rotated about said fulcrum into contacting position with said electrodes.

15. A plug connector as defined in claim 8, wherein said housing and said walls defining said passageway are unitarily molded as a single piece comprising two hollow portions interconnected by a live hinge and which when shut define said enclosed space, said portions further comprising mating parts which coact to lock said portions into their shut position.

16. A plug connector as defined in claim 15, further including a wire cord having a first wire conductor connected to the other of said prongs and a second wire conductor connected to the second said electrode.

17. A fuse connector comprising:

insulating wall structure defining a hollow enclosure including a base wall and a top wall spaced therefrom, and further defining an axially extending passageway within said enclosure;

said wall structure further including a transverse fulcrum wall axially outwardly spaced from an axial end of the wall structure defining the passageway;

said base wall and said top wall each having an axially extending slot therethrough in communication with said passageway to provide a line of sight through said enclosure in an axial plane;

a cartridge fuse mounted within said passageway in axial alignment therewith, said cartridge fuse having a central glass body portion and conducting end caps thereon;

the wall structure defining said passageway being adapted to grip said fuse body portion, and a resilient electrode mounted from said wall structure adjacent each axial end of said passageway located to exert a contact pressure on the respective end caps of said fuse;

said fulcrum serving to engage one axial end of said fuse when it is inserted through said opening in said base wall at an angle thereto as measured in said axial plane, in which position intermediate body portions of said fuse engage said passageway in constricted portions thereof, so that such intermediate body portions act to spring the wall structure defining said passageway apart as an upward force is applied to the other axial end of said fuse, thereby permitting the entry of said fuse into the enclosure to a position within said passageway above said platform.

* * * * *